US008794303B2

(12) United States Patent
Yamada

(10) Patent No.: US 8,794,303 B2
(45) Date of Patent: Aug. 5, 2014

(54) PLATE LAMINATE TYPE HEAT EXCHANGER

(75) Inventor: Tatsuhito Yamada, Kanagawa (JP)

(73) Assignee: Tokyo Roki Co., Ltd., Yokohama-shi (JP)

( * ) Notice: Subject to any disclaimer, the term of this patent is extended or adjusted under 35 U.S.C. 154(b) by 423 days.

(21) Appl. No.: 12/669,886

(22) PCT Filed: Jul. 23, 2007

(86) PCT No.: PCT/JP2007/064426
§ 371 (c)(1),
(2), (4) Date: Feb. 2, 2010

(87) PCT Pub. No.: WO2009/013801
PCT Pub. Date: Jan. 29, 2009

(65) Prior Publication Data

US 2010/0181055 A1 Jul. 22, 2010

(51) Int. Cl.

| | |
|---|---|
| ***F28F 3/04*** | (2006.01) |
| ***F28F 3/08*** | (2006.01) |
| ***F28F 3/14*** | (2006.01) |
| ***F28F 13/06*** | (2006.01) |

(52) U.S. Cl.
USPC ..... 165/167; 165/146; 165/170

(58) Field of Classification Search
USPC ..... 165/167, 170, 148, 146
See application file for complete search history.

(56) References Cited

U.S. PATENT DOCUMENTS

| | | | | |
|---|---|---|---|---|
| 2,567,515 A * | 9/1951 | Janik | ..... | 165/170 |
| 2,872,165 A | 2/1959 | Wennerberg | | |
| 4,133,377 A * | 1/1979 | de Lallee et al. | ..... | 165/167 |
| 4,347,896 A * | 9/1982 | Rosman et al. | ..... | 165/166 |
| 4,911,235 A | 3/1990 | Andersson et al. | | |
| 4,915,165 A | 4/1990 | Dahlgren et al. | | |
| 5,050,671 A * | 9/1991 | Fletcher | ..... | 165/148 |

(Continued)

FOREIGN PATENT DOCUMENTS

| | | |
|---|---|---|
| CN | 1414334 A | 4/2003 |
| DE | 3329325 A1 * | 3/1984 |

(Continued)

OTHER PUBLICATIONS

International Search Report for PCT/JP2007/064426, ISA/JP, mailed Sep. 4, 2007.

(Continued)

*Primary Examiner* — Leonard R Leo
(74) *Attorney, Agent, or Firm* — Harness, Dickey & Pierce, P.L.C.

(57) ABSTRACT

Problem to be Solved

A plate laminate type heat exchanger having high heat exchange efficiency is provided.

Solution

In a plate laminate type heat exchanger 100, both ends of a protrusion 10 converge into an inlet port for high temperature fluid 58*a* and an outlet port for high temperature fluid 58*b*. A pair of core plates 53 and 54 is assembled in such a way that the side of the core plate 53 on which the protrusion 10 is not formed faces the side of the core plate 54 on which the protrusion 10 is not formed and the protrusions 10 and 10 formed on the respective core plates are paired but oriented in opposite directions. The pair of core plates 53 and 54 form a plurality of tubes surrounded by the walls of the protrusions 10 and 10, and the tubes form high temperature fluid compartments.

14 Claims, 11 Drawing Sheets

(56) References Cited

U.S. PATENT DOCUMENTS

| | | | | |
|---|---|---|---|---|
| 5,469,915 | A * | 11/1995 | Cesaroni | 165/171 |
| 5,499,676 | A * | 3/1996 | Cesaroni | 165/166 |
| 5,531,269 | A * | 7/1996 | Dahlgren | 165/167 |
| 6,530,425 | B2 * | 3/2003 | Wehrmann et al. | 165/167 |
| 7,007,506 | B2 * | 3/2006 | Kubo et al. | 165/170 |
| 7,108,054 | B2 * | 9/2006 | Dilley et al. | 165/167 |
| 7,377,308 | B2 * | 5/2008 | Ware | 165/167 |
| 7,600,559 | B2 | 10/2009 | Strahle et al. | |
| 7,717,164 | B2 * | 5/2010 | Richter | 165/167 |
| 2005/0155749 | A1 | 7/2005 | Memory et al. | |

FOREIGN PATENT DOCUMENTS

| | | | |
|---|---|---|---|
| DE | 19959898 | | 6/2001 |
| EP | 1571407 | | 9/2005 |
| GB | 1183183 | | 3/1970 |
| JP | 59-009496 | A | 1/1984 |
| JP | 62-213688 | | 9/1987 |
| JP | 63-501030 | A | 4/1988 |
| JP | 04-313693 | | 11/1992 |
| JP | 4-371794 | | 12/1992 |
| JP | 4-371794 | A | 12/1992 |
| JP | 2000-193392 | | 7/2000 |
| JP | 2001-194086 | A | 7/2001 |
| JP | 2005-226889 | | 8/2005 |
| JP | 2007-127390 | A | 5/2007 |
| WO | 87/01795 | A1 | 3/1987 |

OTHER PUBLICATIONS

Office Action in corresponding European application, mailed Apr. 9, 2013, 7 pages.

Examination Report, European Patent Application No. 07791159.2, Jan. 17, 2014.

* cited by examiner

PRIOR ART

PLATE LAMINATE TYPE HEAT EXCHANGER

CROSS-REFERENCE TO RELATED APPLICATIONS

This application is a 371 U.S. National Stage of International Application No. PCT/JP2007/064426, filed Jul. 23, 2007, the disclosures of which are incorporated herein by reference.

TECHNICAL FIELD

The present invention relates to a plate laminate type heat exchanger, such as an oil cooler and an EGR cooler.

BACKGROUND ART

FIG. 10 shows an example of a plate laminate type heat exchanger of related art. A plate laminate type heat exchanger 500 shown in FIG. 10 includes front and rear end plates 51 and 52 and a plurality of pairs of core plates 53 and 54 (cores 55) laminated therebetween, and peripheral flanges of each of the pairs of core plates 53 and 54 (a peripheral flange 53*a* and a peripheral flange 54*a*, for example) are bonded to each other in a brazing process, whereby high temperature fluid and low temperature fluid compartments are defined by alternately laminating in the space surrounded by the end plates 51, 52 and the core plates 53, 54, and each of the fluid compartments communicates with pairs of circulation pipes 56*a*, 56*b* and 57*a*, 57*b* provided on the front end plate 51 in such a way that the circulation pipes jut therefrom. An intermediate core plate 27 having fins 25 formed thereon is interposed between each pair of the core plates 53 and 54 (see Japanese Patent Laid-Open Nos. 2001-194086 and 2007-127390, for example).

Each of the core plates 53 and 54 has a substantially flat-plate shape. An inlet port for high temperature fluid 58*a* and an outlet port for low temperature fluid 59*b* are provided in each of the core plates 53 and 54 on one end side in the longitudinal direction thereof. On the other hand, an outlet port for high temperature fluid 58*b* and an inlet port for low temperature fluid 59*a* are provided in each of the core plates 53 and 54 on the other end side in the longitudinal direction thereof. The inlet port for high temperature fluid 58*a* and the outlet port for high temperature fluid 58*b*, as well as the inlet port for low temperature fluid 59*a* and the outlet port for low temperature fluid 59*b* of each of the core plates 53 and 54 are disposed in the vicinity of the respective corners thereof, and the pair of the inlet port for high temperature fluid 58*a* and the outlet port for high temperature fluid 58*b* and the pair of the inlet port for low temperature fluid 59*a* and the outlet port for low temperature fluid 59*b* of each of the core plates 53 and 54 are located substantially on the respective diagonal lines thereof. Each of the pairs of core plates 53 and 54 form a core 55. A high temperature fluid compartment through which the high temperature fluid (oil or EGR gas, for example) flows is defined in each of the cores 55. On the other hand, a low temperature fluid compartment through which the low temperature fluid (cooling water, for example) flows is defined between cores 55. The high temperature fluid compartments and the low temperature fluid compartments communicate with the circulation pipes 56*a*, 56*b* and the circulation pipes 57*a*, 57*b*, respectively. The high temperature fluid and the low temperature fluid are introduced into the respective fluid compartments or discharged out of the respective fluid compartments via the circulation pipes 56*a*, 56*b* and the circulation pipes 57*a*, 57*b*. The high temperature fluid and the low temperature fluid, when flowing through the respective fluid compartments, exchange heat via the core plates 53 and 54. FIG. 11 shows the heat exchange process. The core plate shown in FIG. 11 differs from the core plate shown in FIG. 10 in terms of shape. In FIG. 11, the portions that are the same as or similar to those in FIG. 10 have the same reference characters.

DISCLOSURE OF THE INVENTION

Problems to be Solved by the Invention

As shown in FIG. 11, the high temperature fluid and the low temperature fluid flow substantially linearly from the inlet ports 58*a* and 59*a* toward the outlet ports 58*b* and 59*b*. The core plates 53 and 54 therefore have large areas that do not contribute to the heat transfer, that is, the heat exchange between the high temperature fluid and the low temperature fluid (see the portions V in FIG. 11). As a result, the plate laminate type heat exchanger 500 of related art has a problem of low heat exchange efficiency.

The present invention has been made in view of the problem described above. An object of the present invention is to provide a plate laminate type heat exchanger having high heat exchange efficiency.

Means for Solving the Problems

To solve the problem described above, the present invention provides a plate laminate type heat exchanger comprising front and rear end plates; a plurality of pairs of core plates laminated therebetween; and high temperature fluid compartments through which high temperature fluid flows and low temperature fluid compartments through which low temperature fluid flows defined in the space surrounded by the end plates and the core plates by bonding peripheral flanges of each of the pairs of core plates to each other in a brazing process, each of the fluid compartments communicating with a pair of circulation pipes provided on the front or rear end plate in such a way that the circulation pipes jut therefrom. The plate laminate type heat exchanger is characterized by the following features: A plurality of groove-like protrusions is formed on one side of each of the flat core plates, and the protrusions are disposed substantially in parallel to the longitudinal direction of the plate. An inlet port for high temperature fluid and an outlet port for low temperature fluid are provided in each of the core plates on one end side in the longitudinal direction thereof, and an outlet port for high temperature fluid and an inlet port for low temperature fluid are provided in each of the core plates on the other end side in the longitudinal direction thereof. The pair of the inlet port for high temperature fluid and the outlet port for high temperature fluid and the pair of the inlet port for low temperature fluid and the outlet port for low temperature fluid are disposed substantially on the respective diagonal lines of each of the core plates. Both ends of each of the protrusions converge into the inlet port for high temperature fluid and the outlet port for high temperature fluid, respectively. Each of the pairs of core plates is assembled in such a way that the side of one of the two core plates that is opposite the one side faces the side of the other one of the two core plates that is opposite the one side and the protrusions formed on the respective core plates are paired but oriented in opposite directions, and the pair of core plates form a plurality of tubes surrounded by the walls of the protrusions formed on the respective core plates, and the tubes form the corresponding high temperature fluid compartments.

The present invention is also characterized in that each of the core plates has a substantially parallelogram shape when viewed in the laminate direction, and the inlet port for high temperature fluid and the outlet port for high temperature fluid are disposed at a pair of corners where the diagonal angles are larger, whereas the inlet port for low temperature fluid and the outlet port for low temperature fluid are disposed at a pair of corners where the diagonal angles are smaller.

The present invention is also characterized in that the tubes are configured in such a way that a tube having a shorter end-to-end length has a smaller cross-sectional area in the width direction of the core plates.

The present invention also provides a plate laminate type heat exchanger comprising front and rear end plates; a plurality of pairs of core plates laminated therebetween; and high temperature fluid compartments through which high temperature fluid flows and low temperature fluid compartments through which low temperature fluid flows defined in the space surrounded by the end plates and the core plates by bonding peripheral flanges of each of the pairs of core plates to each other in a brazing process, each of the fluid compartments communicating with a pair of circulation pipes provided on the front or rear end plate in such a way that the circulation pipes jut therefrom. The plate laminate type heat exchanger is characterized by the following features: A plurality of groove-like protrusions is formed on one side of each of the flat core plates, and the protrusions are disposed substantially in parallel to the longitudinal direction of the plate. Each of the plates is curved in such a way that ridges and valleys are formed in the direction in which the plates are laminated and the ridges and valleys are repeated along the longitudinal direction of the plates. An inlet port for high temperature fluid and an outlet port for low temperature fluid are provided in each of the core plates on one end side in the longitudinal direction thereof, and an outlet port for high temperature fluid and an inlet port for low temperature fluid are provided in each of the core plates on the other end side in the longitudinal direction thereof. The pair of the inlet port for high temperature fluid and the outlet port for high temperature fluid and the pair of the inlet port for low temperature fluid and the outlet port for low temperature fluid are disposed substantially on the respective diagonal lines of each of the core plates. Both ends of each of the protrusions converge into the inlet port for high temperature fluid and the outlet port for high temperature fluid, respectively. Each of the pairs of core plates is assembled in such a way that the side of one of the two core plates that is opposite the one side faces the side of the other one of the two core plates that is opposite the one side and the protrusions formed on the respective core plates are paired but oriented in opposite directions.

The present invention is also characterized in that each of the protrusions also has ridges and valleys formed in the width direction of the core plates perpendicular to the longitudinal direction of the core plates, and the ridges and valleys are repeated along the longitudinal direction of the core plates.

The present invention is also characterized in that the protrusions formed on each of the pairs of core plates are the same in terms of the period and the amplitude of the waves formed of the ridges and valleys formed in the width direction of the core plates.

The present invention is also characterized in that the protrusions meander in an in-phase manner along the longitudinal direction of the core plates.

The present invention is also characterized in that each of the pairs of core plates form a plurality of serpentine tubes surrounded by the walls of the protrusions, and the serpentine tubes form the corresponding high temperature fluid compartment.

The present invention is also characterized in that the protrusions meander in an anti-phase manner along the longitudinal direction of the core plates.

The present invention is also characterized in that second protrusions are formed on the walls that form the protrusions along the direction substantially perpendicular to the direction in which the high temperature fluid flows.

DESCRIPTION OF SYMBOLS

10, 30, 40 protrusion
50 second protrusion
58*a* inlet port for high temperature fluid
58*b* outlet port for high temperature fluid
59*a* inlet port for low temperature fluid
59*b* outlet port for low temperature fluid
100, 110, 120, 150, 160, 200, 300, 400 plate laminate type heat exchanger

BEST MODE FOR CARRYING OUT THE INVENTION

Embodiments of the present invention will be described below with reference to the accompanying drawings.

First Embodiment

A first embodiment of the present invention will first be described with reference to FIGS. 1 to 3.

Figure 1:
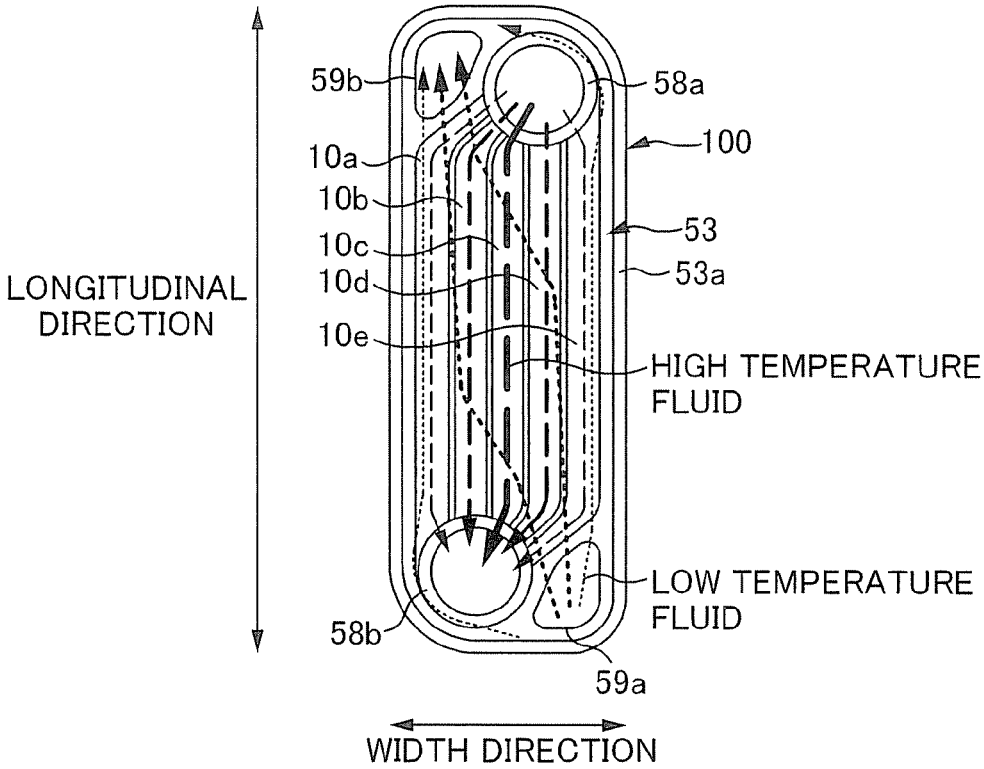
FIG. 1 shows how high temperature fluid and low temperature fluid exchange heat via a core plate 53 in a plate laminate type heat exchanger 100.
Figure 2:
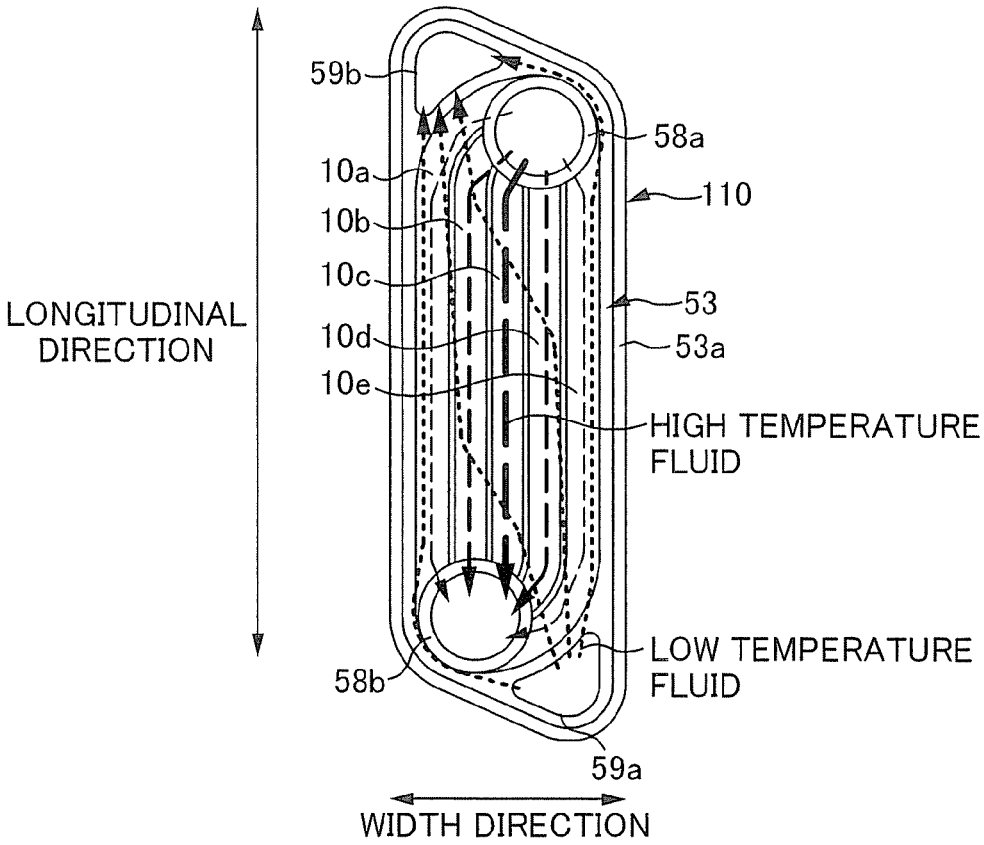
FIG. 2 shows how high temperature fluid and low temperature fluid exchange heat via a core plate 53 in a plate laminate type heat exchanger 110.
Figure 3:
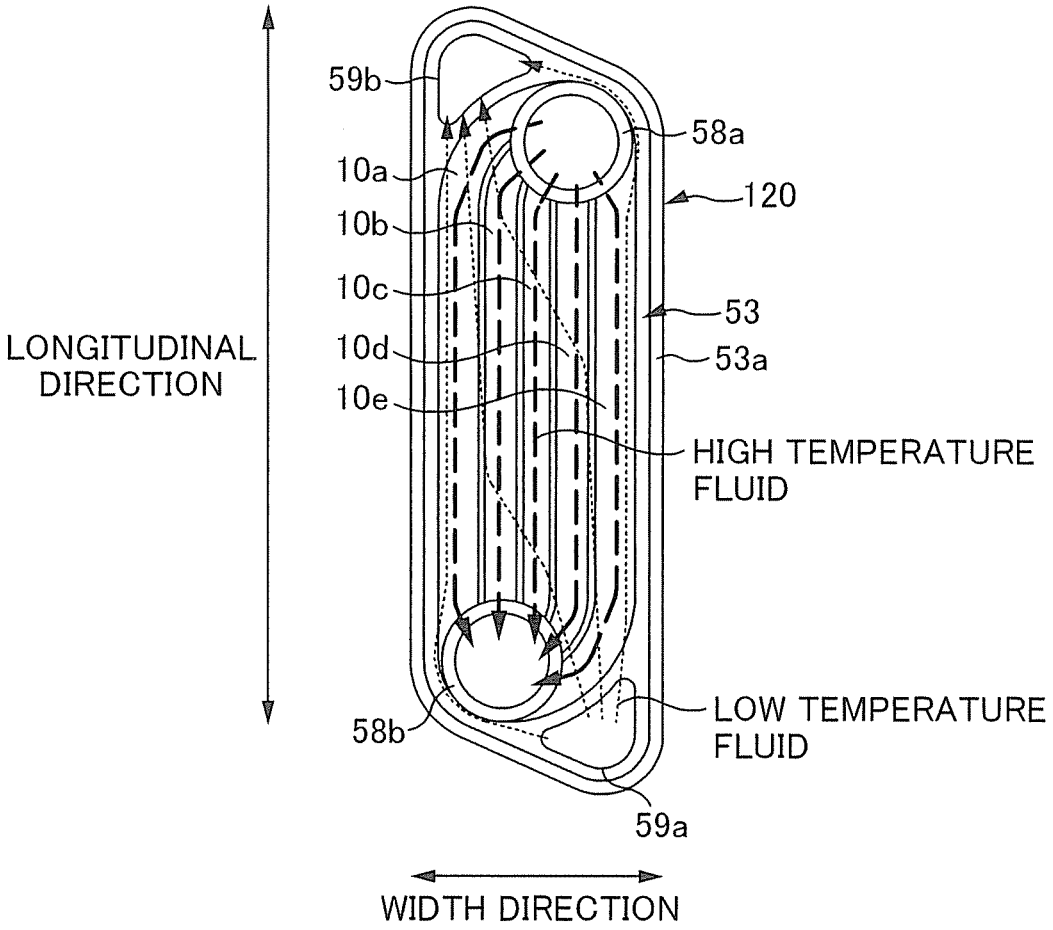
FIG. 3 shows how high temperature fluid and low temperature fluid exchange heat via a core plate 53 in a plate laminate type heat exchanger 120.
Figure 10:
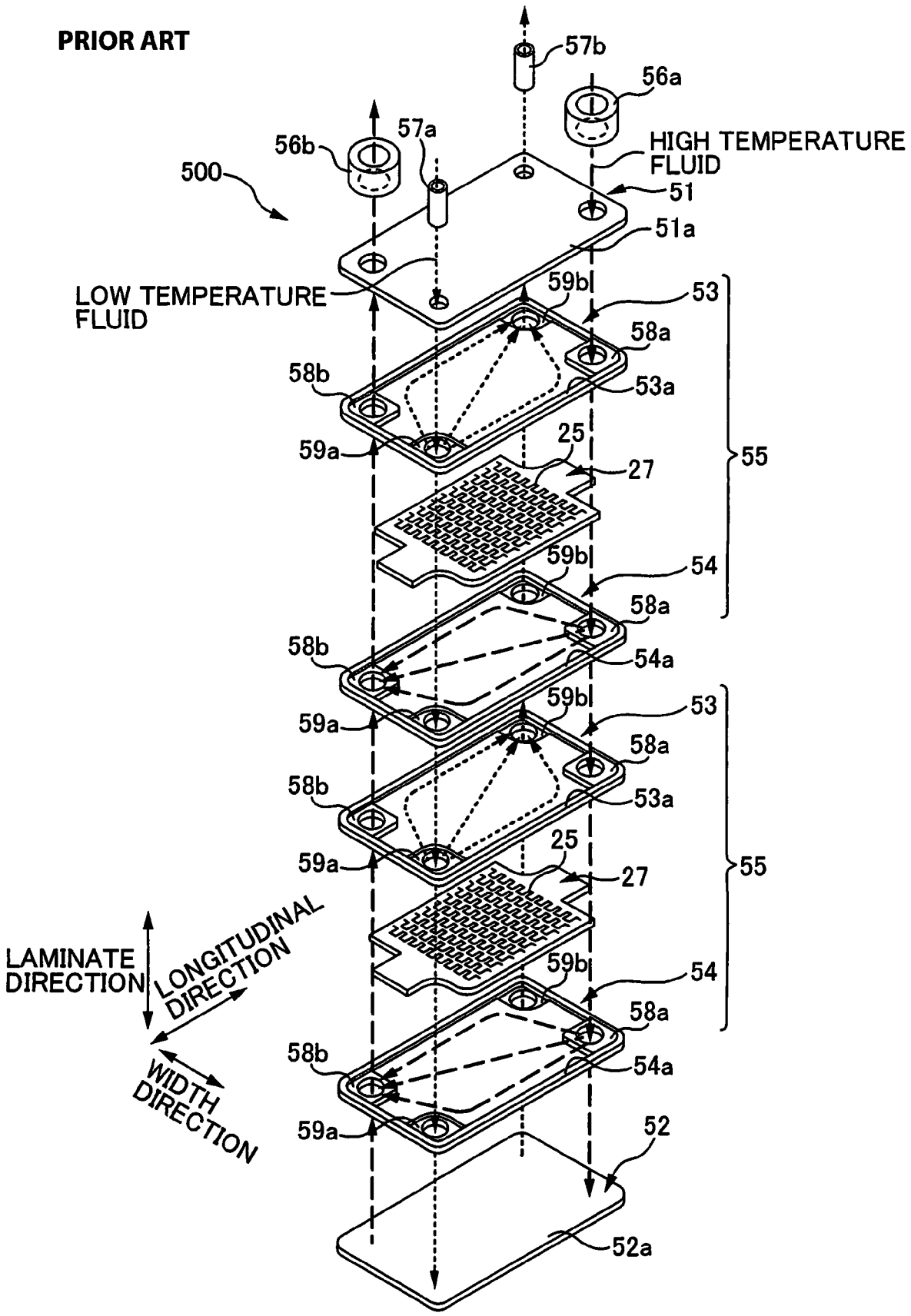
FIG. 10 is an exploded perspective view of a plate laminate type heat exchanger 500 of prior art.
Figure 11:
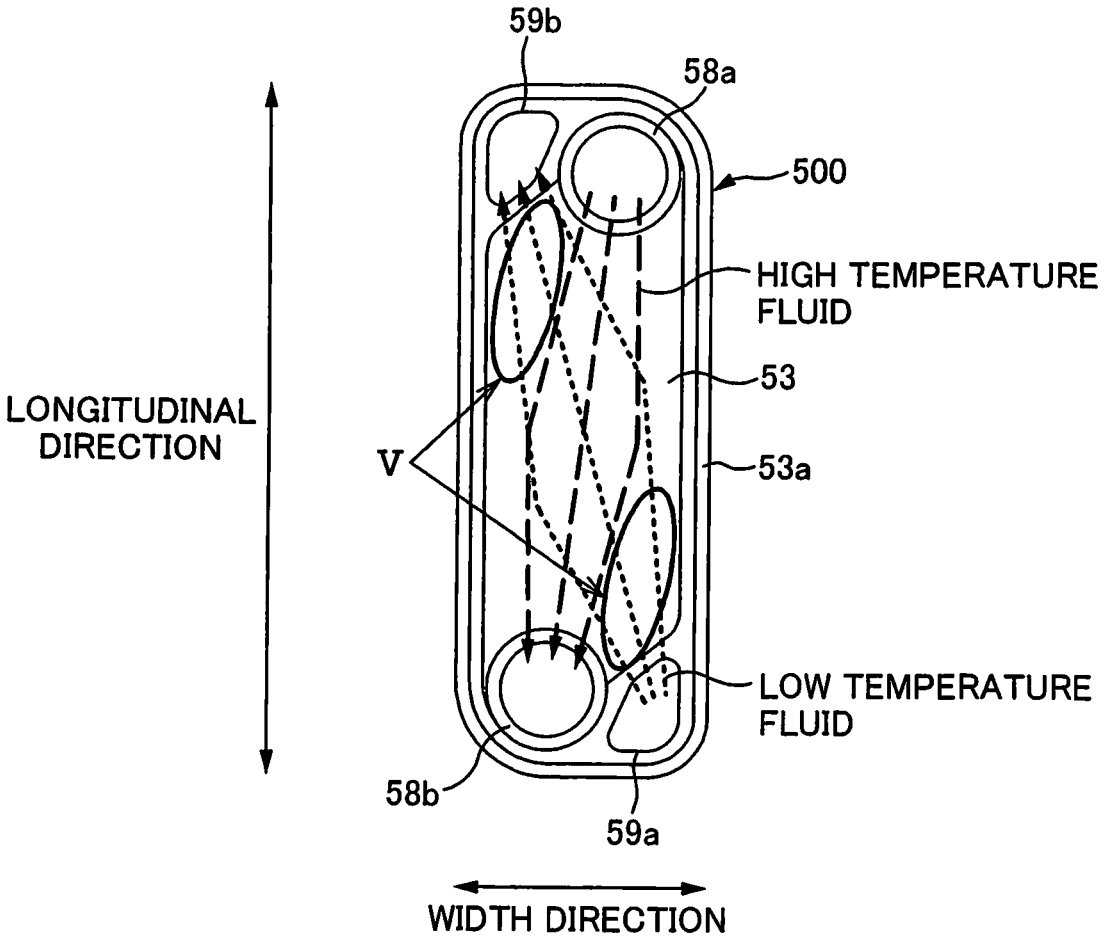
FIG. 11 shows how high temperature fluid and low temperature fluid exchange heat via a core plate 53 in the plate laminate type heat exchanger 500 of prior art.

FIGS. 1 to 3 show how high temperature fluid and low temperature fluid exchange heat via a core plate 53 in plate laminate type heat exchangers 100, 110, and 120 according to the first embodiment of the present invention. In FIGS. 1 to 3, the portions that are the same as or similar to those shown in FIGS. 10 and 11 have the same reference characters.

Each of the plate laminate type heat exchangers 100, 110, and 120 shown in FIGS. 1 to 3 includes front and rear end plates 51 and 52 and a plurality of pairs of core plates 53 and 54 laminated therebetween, and peripheral flanges of each of the pairs of core plates 53 and 54 (a peripheral flange 53*a* and a peripheral flange 54*a*, for example) are bonded to each other in a brazing process, whereby high temperature fluid compartments through which high temperature fluid flows and low temperature fluid compartments through which low temperature fluid flows are defined in the space surrounded by the end plates 51, 52 and the core plates 53, 54, and each of the fluid compartments communicates with pairs of circulation pipes 56*a*, 56*b* and 57*a*, 57*b* provided on the front end plate 51 in such a way that the circulation pipes jut therefrom.

A plurality of groove-like protrusions 10 is formed on one side of each of the flat core plates 53 and 54, and the protrusions 10*a* to 10*e* are disposed substantially in parallel to the longitudinal direction of the plate. An inlet port for high temperature fluid 58*a* and an outlet port for low temperature fluid 59*b* are provided in each of the core plates 53 and 54 on one end side in the longitudinal direction thereof. On the other hand, an outlet port for high temperature fluid 58*b* and an inlet port for low temperature fluid 59*a* are provided in each of the core plates 53 and 54 on the other end side in the longitudinal direction thereof. The inlet port 58*a* and the outlet port 58*b*, as well as the inlet port 59*a* and the outlet port 59*b* of each of the core plates 53 and 54 are disposed in the vicinity of the respective corners thereof, and the pair of the inlet port 58*a* and the outlet port 58*b* and the pair of the inlet port 59*a* and the outlet port 58*b* of each of the core plates 53 and 54 are located substantially on the respective diagonal lines thereof. Both ends of each of the protrusions 10 converge into the inlet port for high temperature fluid 58*a* and the outlet port for high temperature fluid 58*b*, respectively. Specifically, both end portions of each of the protrusions 10*a* to 10*e* have substantially arcuate shapes and are connected to the inlet port for high temperature fluid 58*a* and the outlet port for high temperature fluid 58*b*. Each of the pairs of core plates 53 and 54 is assembled in such a way that the side of the core plate 53 that is opposite the one side described above faces the side of the core plate 54 that is opposite the one side described above and the protrusions 10 and 10 formed on the respective core plates are paired but oriented in opposite directions. The pair of core plates 53 and 54 form a plurality of tubes surrounded by the walls of the protrusions 10 and 10, and the tubes form the corresponding high temperature fluid compartments.

The core plate 53 shown in FIG. 1 has a substantially rectangular shape when viewed in the direction in which the core plates 53 and 54 are laminated. On the other hand, the core plates 53 shown in FIGS. 2 and 3 have substantially parallelogram shapes when viewed in the direction in which the core plates 53 and 54 are laminated. In the core plates 53 shown in FIGS. 2 and 3, the inlet port for high temperature fluid 58*a* and the outlet port for high temperature fluid 58*b* are disposed at a pair of corners where the diagonal angles are larger, whereas the inlet port for low temperature fluid 59*a* and the outlet port for low temperature fluid 59*b* are disposed at a pair of corners where the diagonal angles are smaller.

In each of the core plates 53 shown in FIGS. 1 to 3, each of the inlet port for high temperature fluid 58*a* and the outlet port for high temperature fluid 58*b* has a substantially circular cross-sectional shape. On the other hand, each of the inlet port for low temperature fluid 59*a* and the outlet port for low temperature fluid 59*b* has a shape obtained by deforming a substantially circular cross-sectional shape, specifically, a shape obtained by deforming a substantially circular cross-sectional shape as appropriate in accordance with the shape of the corresponding corner of the core plate 53, the shapes of the adjacent inlet port for high temperature fluid 58*a* and outlet port for high temperature fluid 58*b*, and the shape of the converging regions of the protrusions 10*a* to 10*e* disposed on the end sides in the width direction of the core plate 53.

The plurality of tubes formed in the plate laminate type heat exchangers 100 and 110 shown in FIGS. 1 and 2 are configured in such a way that the cross-sectional areas of the tubes in the width direction of the core plates 53 and 54 are substantially the same, and the protrusions 10*a* to 10*e* that form the tubes have cross-sectional areas in the width direction of the core plates 53 and 54 that satisfy the following relationship: That is, the cross-sectional area of the protrusion 10*a*=the cross-sectional area of the protrusion 10*b*=the cross-sectional area of the protrusion 10*c*=the cross-sectional area of the protrusion 10*d*=the cross-sectional area of the protrusion 10*e*. On the other hand, the tubes formed in the plate laminate type heat exchanger 120 shown in FIG. 3 are formed in such a way that a tube having a longer end-to-end length has a greater cross-sectional area, whereas a tube having a shorter end-to-end length, that is, a tube whose length between the converging portion leading to the inlet port for high temperature fluid 58*a* and the converging portion leading to the outlet port for high temperature fluid 58*b* is shorter, has a smaller cross-sectional area in the width direction of the core plates 53 and 54. More specifically, the tubes formed in the plate laminate type heat exchanger 120 are configured in such a way that a tube disposed in a position closer to the center of the core plates 53 and 54 and farther apart from both ends in the width direction of the core plates 53 and 54 has a smaller cross-sectional area in the width direction of the core plates 53 and 54, and the protrusions 10*a* to 10*e* that form the tubes have cross-sectional areas in the width direction of the core plates 53 and 54 that satisfy the following relationship: That is, the cross-sectional area of the protrusion 10*a*=the cross-sectional area of the protrusion 10*e*>the cross-sectional area of the protrusion 10*b*=the cross-sectional area of the protrusion 10*d*>the cross-sectional area of the protrusion 10*c*.

In the plate laminate type heat exchangers 100, 110, and 120, a pair of core plates 53 and 54 form a plurality of tubes surrounded by the walls of the protrusions 10 and 10, and the tubes form the corresponding high temperature fluid compartments. Further, both ends of each of the tubes are configured to converge into the inlet port for high temperature fluid 58*a* and the outlet port for high temperature fluid 58*b*, respectively. As a result, the high temperature fluid flows through the tube-shaped high temperature fluid compartment and flows in an arcuate and circular manner in the vicinity of the inlet port for high temperature fluid 58*a* and the outlet port for high temperature fluid 58*b*. In the flow process, the high temperature fluid thus comes into contact with a large area of the core plates 53 and 54. Consequently, the area of the core plates 53 and 54 that does not contribute to heat transfer decreases, and the core plates 53 and 54 have a large area that contributes to heat exchange between the high temperature fluid and the low temperature fluid. As a result, the effective heat transfer areas of the core plates 53 and 54 increase by approximately 10 to 15%. The heat exchange efficiency between the high temperature fluid and the low temperature fluid in the plate laminate type heat exchangers 100, 110, and 120 is therefore higher than that in the plate laminate type heat exchanger 500 of related art. Specifically, the heat exchange efficiency is improved by 5 to 10%.

In the plate laminate type heat exchangers 110 and 120, each of the core plates 53 and 54 has a substantially parallelogram shape, and the low temperature fluid flowing through the tubes disposed on the end sides in the width direction of the core plates 53 and 54 flows in a circular manner at a large radius in the vicinity of the inlet port for high temperature fluid 58*a* and the outlet port for high temperature fluid 58*b*. As a result, the area of the core plates 53 and 54 that does not contribute to heat transfer further decreases, and the core plates 53 and 54 have larger areas that contribute to heat exchange between the high temperature fluid and the low temperature fluid. The heat exchange efficiency in the plate laminate type heat exchangers 110 and 120 is therefore higher than that in the plate laminate type heat exchanger 100.

Further, in the plate laminate type heat exchanger 120, the tubes described above are configured in such a way that a tube disposed in a position closer to the center of the core plates 53 and 54 and farther apart from both ends in the width direction of the core plates 53 and 54 has a smaller cross-sectional area in the width direction of the core plates 53 and 54. Consequently, in the plate laminate type heat exchanger 120, the high temperature fluid flows through the tubes disposed on the end sides in the width direction of the core plates 53 and 54 at a flow volume rate similar to that flowing through the tubes disposed at the center of the core plates 53 and 54. As a result, the flow rate of the high temperature fluid flowing through the tubes disposed on the end sides in the width direction of the core plates 53 and 54 is substantially the same as the flow rate of the high temperature fluid flowing through the tubes disposed at the center of the core plates 53 and 54, whereby the flow rates of the high temperature fluid flowing through all the tubes are substantially the same. The heat exchange efficiency in the plate laminate type heat exchanger 120 is therefore higher than that in the plate laminate type heat exchanger 110.

Second Embodiment

A second embodiment of the present invention will be described with reference to FIG. 4.

Figure 4:
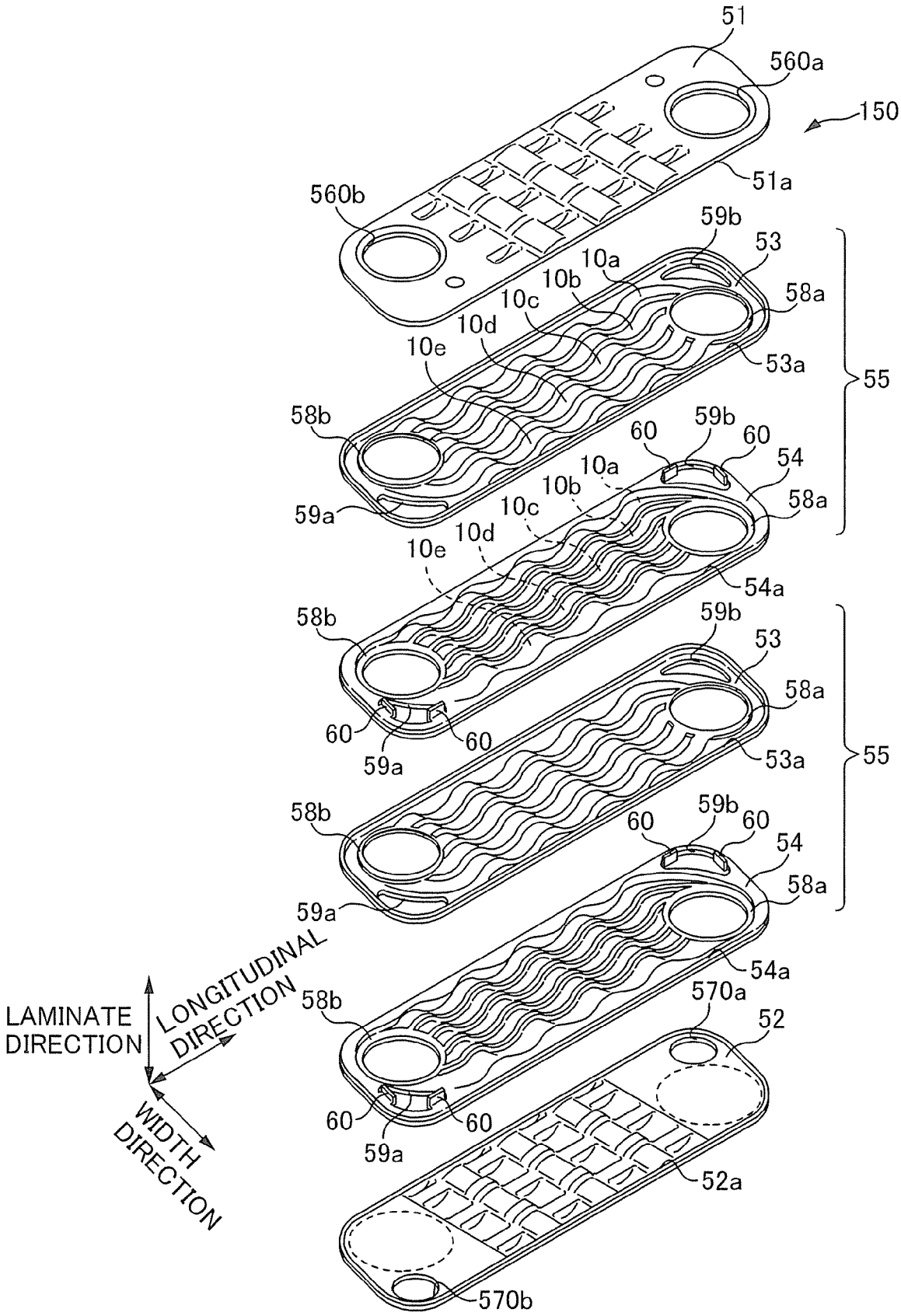
FIG. 4 is an exploded perspective view of a plate laminate type heat exchanger 150.

FIG. 4 is an exploded perspective view of a plate laminate type heat exchanger 150 according to the second embodiment of the present invention. In FIG. 4, the portions that are the same as or similar to those shown in FIGS. 1 to 3 have the same reference characters.

The plate laminate type heat exchanger 150 shown in FIG. 4 includes front and rear end plates 51 and 52 and a plurality of pairs of core plates 53 and 54 laminated therebetween, and peripheral flanges of each of the pairs of core plates 53 and 54 are bonded to each other in a brazing process, whereby high temperature fluid compartments through which high temperature fluid flows and low temperature fluid compartments through which low temperature fluid flows are defined in the space surrounded by the end plates 51, 52 and the core plates 53, 54. The high temperature fluid compartments communicate with a pair of circulation pipes 56*a* and 56*b* (not shown) provided on the front end plate 51 in such a way that the circulation pipes jut therefrom, whereas the low temperature fluid compartments communicate with a pair of circulation pipes 57*a* and 57*b* (not shown) provided on the rear end plate 52 in such a way that the circulation pipes jut therefrom. Connection holes 560*a* and 560*b* for connecting the circulation pipes 56*a* and 56*b* are formed in the front end plate 51, and connection holes 570*a* and 570*b* for connecting the circulation pipes 57*a* and 57*b* are formed in the rear end plate 52. The end plates 51 and 52 have raised and recessed portions as appropriate in accordance with the shapes of the core plates 53 and 54.

A plurality of groove-like protrusions 10 is formed on one side of each of the flat core plates 53 and 54, and the protrusions 10*a* to 10*e* are disposed substantially in parallel to the longitudinal direction of the plate. Each of the flat plates is curved in such a way that ridges and valleys are formed in the direction in which the plates are laminated and the ridges and valleys are repeated along the longitudinal direction of the plates. Each of the core plates 53 and 54 has a substantially rectangular shape when viewed in the direction in which the core plates 53 and 54 are laminated.

An inlet port for high temperature fluid 58*a* and an outlet port for low temperature fluid 59*b* are provided in each of the core plates 53 and 54 on one end side in the longitudinal direction thereof. On the other hand, an outlet port for high temperature fluid 58*b* and an inlet port for low temperature fluid 59*a* are provided in each of the core plates 53 and 54 on the other end side in the longitudinal direction thereof. In each of the core plates 54, attachment portions 60 are formed integrally therewith at the inlet port for low temperature fluid 59*a* and the outlet port for low temperature fluid 59*b*. The inlet port for high temperature fluid 58*a* and the outlet port for high temperature fluid 58*b*, as well as the inlet port for low temperature fluid 59*a* and the outlet port for low temperature fluid 59*b* of each of the core plates 53 and 54 are disposed at the respective corners thereof, and the pair of the inlet port for high temperature fluid 58*a* and the outlet port for high temperature fluid 58*b* and the pair of the inlet port for low temperature fluid 59*a* and the outlet port for low temperature fluid 59*b* of each of the core plates 53 and 54 are located substantially on the diagonal lines thereof. Both ends of each of the protrusions 10 converge into the inlet port for high temperature fluid 58*a* and the outlet port for high temperature fluid 58*b*, respectively. Each of the pairs of core plates 53 and 54 is assembled in such a way that the side of the core plate 53 that is opposite the one side described above faces the side of the core plate 54 that is opposite the one side described above and the protrusions 10 and 10 formed on the respective core plates are paired but oriented in opposite directions.

In the plate laminate type heat exchanger 150, a pair of core plates 53 and 54 form a plurality of tubes surrounded by the walls of the protrusions 10 and 10, and the tubes form the corresponding high temperature fluid compartments. Both ends of each of the tubes are configured to converge into the inlet port for high temperature fluid 58*a* and the outlet port for high temperature fluid 58*b*, respectively. Further, ridges and valleys are formed in the direction in which the core plates 53 and 54 are laminated and the ridges and valleys are repeated along the longitudinal direction of the core plates 53 and 54. As a result, the high temperature fluid flows through the high temperature fluid compartment having the complex structure described above and flows in an arcuate and circular manner in the vicinity of the inlet port for high temperature fluid 58*a* and the outlet port for high temperature fluid 58*b*. In the flow process, the high temperature fluid thus comes into contact with a large area of the core plates 53 and 54. As a result, the area of the core plates 53 and 54 that does not contribute to heat transfer decreases, and the core plates 53 and 54 have a large area that contributes to heat exchange between the high temperature fluid and the low temperature fluid. Thus, the heat exchange efficiency in the plate laminate type heat exchanger 150 is higher than that in the plate laminate type heat exchanger 500 of related art and even higher than that in the plate laminate type heat exchanger 100 described above.

Third Embodiment

A third embodiment of the present invention will be described with reference to FIG. 5.

Figure 5:
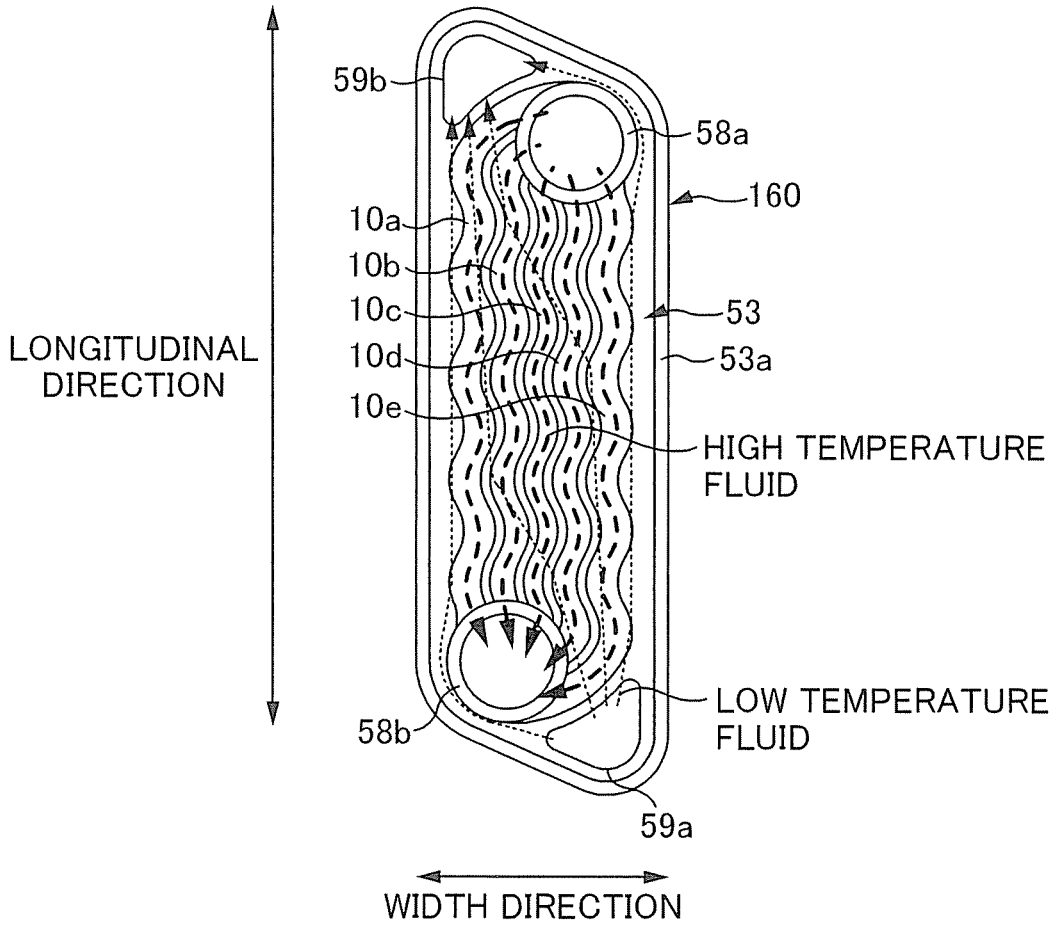
FIG. 5 shows how high temperature fluid and low temperature fluid exchange heat via a core plate 53 in a plate laminate type heat exchanger 160.

FIG. 5 shows how high temperature fluid and low temperature fluid exchange heat via a core plate 53 in a plate laminate type heat exchanger 160 according to the third embodiment of the present invention. In FIG. 5, the portions that are the same as or similar to those shown in FIG. 4 have the same reference characters. In the following description of the core plate 53 in the plate laminate type heat exchanger 160, portions of the core plate 53 different from those shown in FIG. 4 will be primarily described.

In the plate laminate type heat exchanger 160 shown in FIG. 5, the core plate 53 has a substantially parallelogram shape when viewed in the direction in which the core plates 53 and 54 are laminated. In the core plate 53, an inlet port for high temperature fluid 58*a* and an outlet port for high temperature fluid 58*b* are disposed at a pair of corners where the diagonal angles are larger, whereas an inlet port for low temperature fluid 59*a* and an outlet port for low temperature fluid 59*b* are disposed at a pair of corners where the diagonal angles are smaller. Protrusions 10*a* to 10*e* are formed on the core plate 53 and disposed substantially in parallel to the longitudinal direction of the core plate 53. The protrusions 10*a* to 10*e* have ridges and valleys formed in the direction in which the core plate 53 is laminated, as in the protrusions 10*a* to 10*e* shown in FIG. 4. The ridges and valleys are periodically repeated along the longitudinal direction of the core plate 53. The protrusions 10*a* to 10*e* also have ridges and valleys formed in the width direction of the core plate 53. The ridges and valleys are periodically repeated along the longitudinal direction of the core plate 53. The wave formed of the ridges and valleys formed in the direction in which the core plate 53 is laminated and the wave formed of the ridges and valleys formed in the width direction of the core plate 53 have the same wave period. The ridges and valleys formed in the direction in which the core plate 53 is laminated are disposed in positions where the ridges and valleys are in phase with the ridges and valleys formed in the width direction of the core plate 53. The configuration of the present invention is, however, not limited to the configuration described above. For example, the present invention may alternatively be configured in such a way that the ridges and valleys formed in the direction in which the core plate 53 is laminated correspond to the ridges and valleys formed in the direction in which the core plate 53 is laminated.

The protrusions 10 and 10 formed in a pair of core plates 53 and 54 are configured to meander along the longitudinal direction of the core plates 53 and 54 while being in phase with each other. A pair of core plates 53 and 54 form a plurality of serpentine tubes surrounded by the walls of the protrusions 10 and 10, and the serpentine tubes form the corresponding high temperature fluid compartments. The serpentine tubes are configured in such a way that a tube disposed in a position closer to the center of the core plates 53 and 54 and farther apart from both ends in the width direction of the core plates 53 and 54 has a smaller cross-sectional area. Specifically, the protrusions 10*a* to 10*e* that form the serpentine tubes have cross-sectional areas in the width direction of the core plates 53 and 54 that satisfy the following relationship: the cross-sectional area of the protrusion 10*a*=the cross-sectional area of the protrusion 10*e*>the cross-sectional area of the protrusion 10*b*=the cross-sectional area of the protrusion 10*d*>the cross-sectional area of the protrusion 10*c*.

In the plate laminate type heat exchanger 160, a pair of core plates 53 and 54 form a plurality of serpentine tubes surrounded by the walls of the protrusions 10 and 10, and the serpentine tubes form the corresponding high temperature fluid compartments. Both ends of each of the serpentine tubes are configured to converge into the inlet port for high temperature fluid 58*a* and the outlet port for high temperature fluid 58*b*, respectively. Further, ridges and valleys are formed in the direction in which the core plates 53 and 54 are laminated, and the ridges and valleys are repeated along the longitudinal direction of the core plates 53 and 54. Ridges and valleys are formed also in the width direction of the core plates 53 and 54, and the ridges and valleys are repeated along the longitudinal direction of the core plates 53 and 54. As a result, the high temperature fluid flows through the high temperature fluid compartment formed of the serpentine tubes and flows in an arcuate and circular manner in the vicinity of the inlet port for high temperature fluid 58*a* and the outlet port for high temperature fluid 58*b*. In the flow process, the high temperature fluid thus comes into contact with a large area of the core plates 53 and 54. As a result, the area of the core plates 53 and 54 that does not contribute to heat transfer decreases, and the core plates 53 and 54 have a large area that contributes to heat exchange between the high temperature fluid and the low temperature fluid. Thus, the heat exchange efficiency in the plate laminate type heat exchanger 160 is higher than that in the plate laminate type heat exchanger 500 of related art and even higher than that in the plate laminate type heat exchanger 150 described above.

Other Embodiments

Another embodiment of the present invention will be described with reference to FIGS. 6A, 6B and FIGS. 7A, 7B. FIGS. 6A, 6B and FIGS. 7A, 7B show improved portions of a plate laminate type heat exchanger 200 according to another embodiment of the present invention. FIGS. 7A and 7B show second protrusions 50 formed on protrusions 30 and 40 shown in FIGS. 6A and 6B. In FIGS. 6A, 6B and FIGS. 7A, 7B, the same or similar portions have the same reference characters.

The plate laminate type heat exchanger 200 shown in FIGS. 6A, 6B and FIGS. 7A, 7B includes front and rear end plates 51 and 52 and a plurality of pairs of core plates 13 and 14 (cores 15) laminated therebetween, and peripheral flanges of each of the pairs of core plates 13 and 14 are bonded to each other in a brazing process, whereby high temperature fluid compartments are alternately laminated in the space surrounded by the end plates 51, 52 and the core plates 13, 14, and each of the fluid compartments communicates with pairs of circulation pipes 56*a*, 56*b* and 57*a*, 57*b* provided on the front end plate 51 in such a way that the circulation pipes jut therefrom.

Each of the core plates 13 and 14 is an improved flat plate. Specifically, a plurality of corrugated protrusions 30 and 40 are formed on one side of each of the flat core plates 13 and 14, and the corrugated protrusions 30 and 40 continuously meander along the longitudinal direction of the plates. Each of the plates is curved in such a way that ridges and valleys are disposed in the direction in which the plates are laminated and the ridges and valleys are repeated along the longitudinal direction of the plates. The plurality of protrusions 30 and 40 are disposed in parallel to the longitudinal direction of the core plates 13 and 14 and equally spaced apart from each other. The protrusions 30 and 40 have ridges and valleys formed in the width direction of the core plates 13 and 14, and the ridges and valleys meander in such a way that they are alternately and periodically repeated along the longitudinal direction of the core plates 13 and 14. The protrusions 30 and 40 also have ridges and valleys formed in the direction in which the core plates 13 and 14 are laminated, and the ridges and valleys meander in such a way that they are alternately and periodically repeated along the longitudinal direction of the core plates 13 and 14. The ridges and valleys formed in the width direction of the core plates 13 and 14 are disposed in correspondence with the ridges and valleys formed in the direction in which the core plates 13 and 14 are laminated. The protrusions 30 and 40 are waved not only in the direction in which the core plates 13 and 14 are laminated but also in the width direction of the core plates 13 and 14. The protrusions 30 and 40 are the same in terms of the period, the phase, and the amplitude of the waves formed in the width direction of the core plates 13 and 14.

Figure 6A:
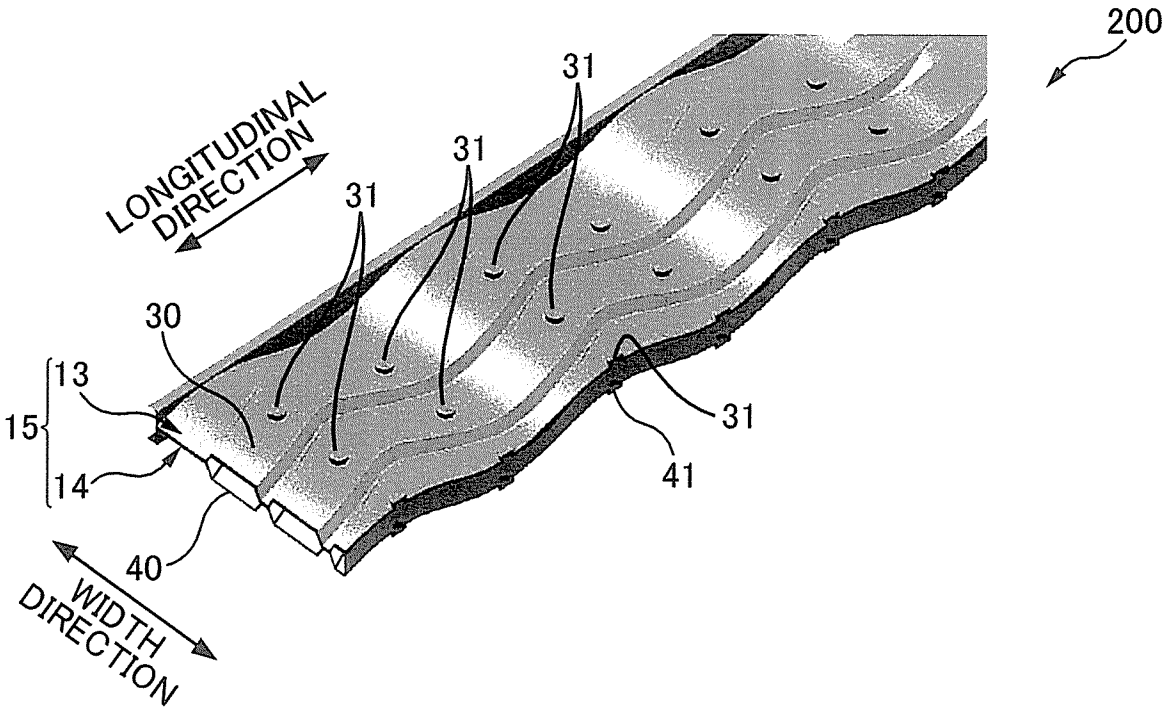
FIG. 6A is a perspective view showing an improved portion of a plate laminate type heat exchanger 200.
Figure 6B:
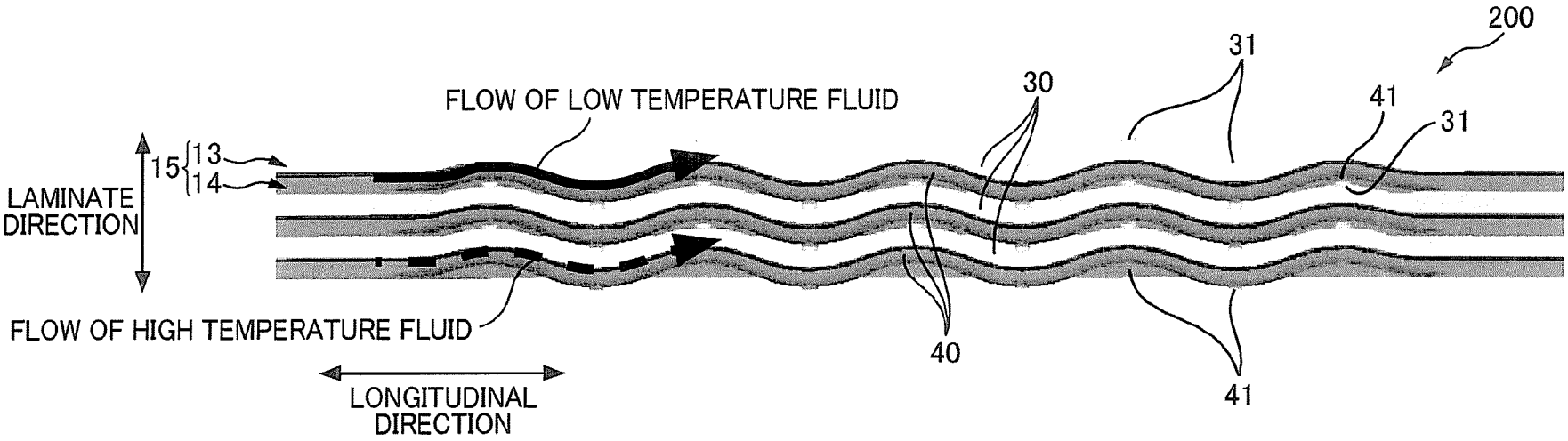
FIG. 6B is a side view showing the improved portion of the plate laminate type heat exchanger 200.
Figure 7A:
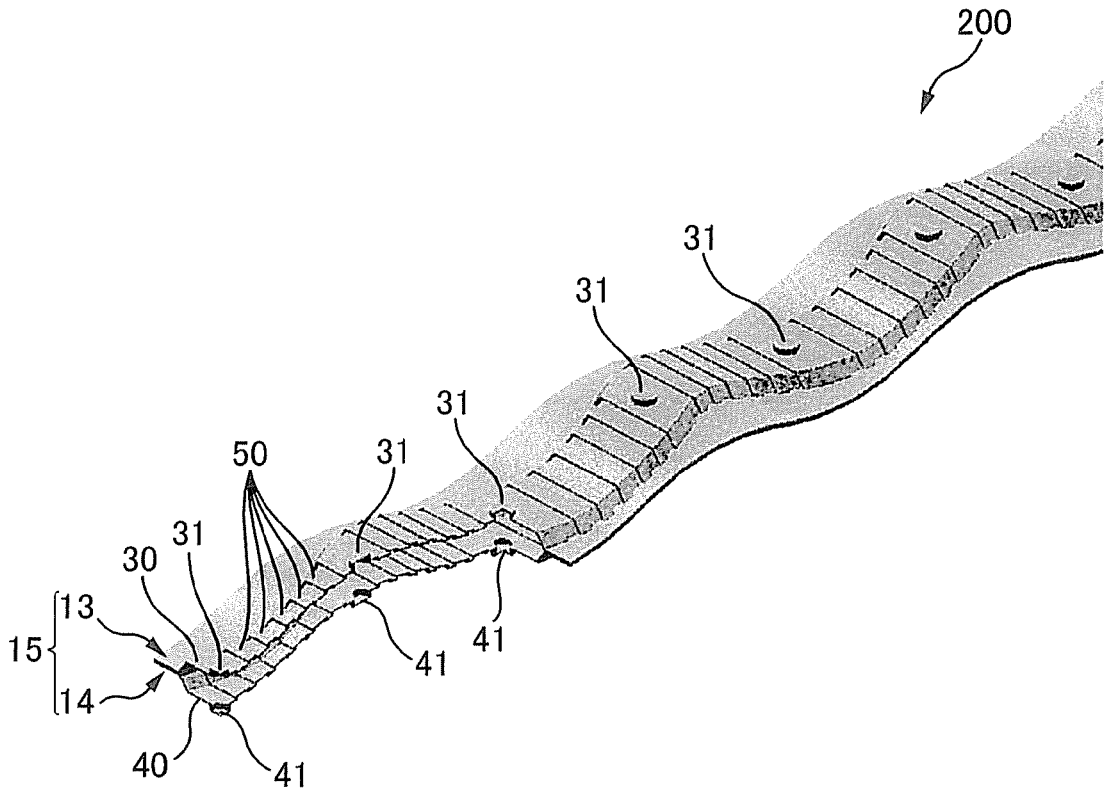
FIG. 7A is a perspective view of the plate laminate type heat exchanger 200 in which second protrusions 50 are formed.
Figure 7B:
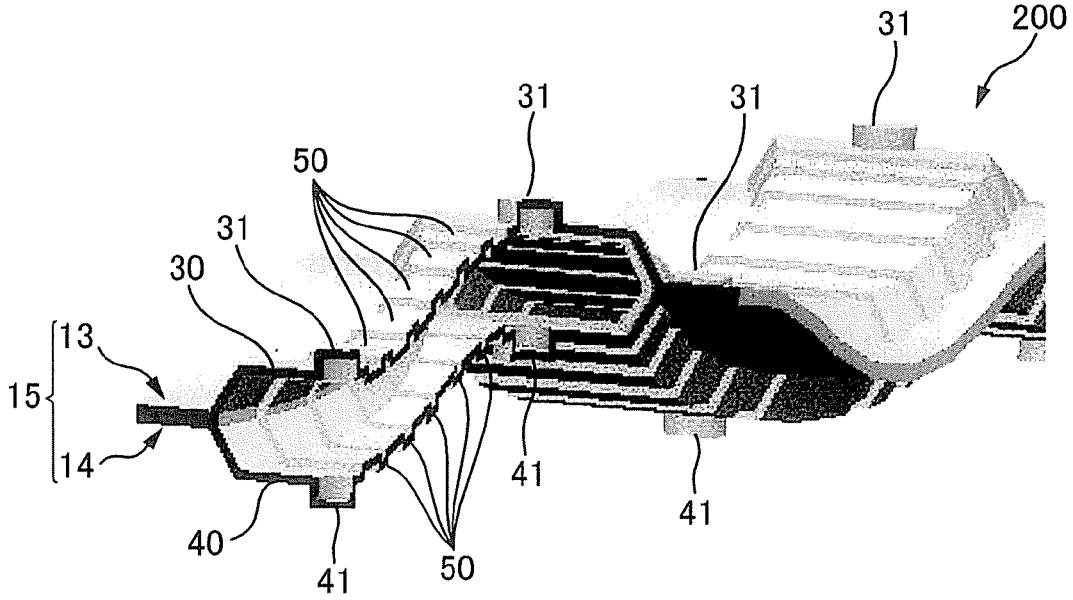
FIG. 7B is an enlarged view showing part of FIG. 7A.

Each of the pairs of core plates 13 and 14 (cores 15) is assembled in such a way that the side of the core plate 13 that is opposite the one side on which the protrusions 30 and 40 are formed faces the side of the core plate 14 that is opposite the one side on which the protrusions 30 and 40 are formed and the protrusions 30 and 40 formed on the respective core plates are paired but oriented in opposite directions (see FIG. 6A). In each of the cores 15, a plurality of serpentine tubes surrounded by the walls of the protrusions 30 and 40 are formed, and the serpentine tubes form the corresponding high temperature fluid compartments. The cores 15 are assembled in such a way that the ridges (valleys) formed on the respective core plates in the laminate direction are overlaid with each other (see FIG. 6B).

The protrusions 30 and 40 oriented in vertically opposite directions are paired and form the serpentine tubes, and serpentine tubes adjacent in the width direction of the core plates 13 and 14 do not communicate with each other. The high temperature fluid therefore separately flows through each single serpentine tube substantially in the longitudinal direction, but does not flow into other adjacent serpentine tubes. The configuration of the present invention, however, is not limited to the configuration described above. For example, the protrusions 30 and 40 may be formed in such a way that they are out of phase by half the period in the longitudinal direction or the width direction of the core plates 13 and 14 so that they do not form serpentine tubes (not shown). In this configuration, the high temperature fluid flows into the portion between adjacent protrusions, whereby more complex high temperature fluid compartments are formed. Further, embossments 31 and 41 are preferably formed on the protrusions 30 and 40 at locations corresponding to the ridges and valleys formed in the direction in which the core plates 13 and 14 are laminated. In this case, when the pairs of core plates 13 and 14 are laminated, pairs of upper and lower embossments 31 and 41 abut each other and form cylindrical members in the low temperature fluid compartments (see FIG. 6B). The cylindrical members support the core plates 13 and 14 in the direction in which they are laminated, whereby the strength of the plates is improved.

As shown in FIGS. 7A and 7B, second protrusions 50 are preferably formed on each of the walls that form the protrusions 30 and 40 so that each of the serpentine tubes has an inner complex structure. That is, small second protrusions 50 are successively formed on each of the walls that form the protrusions 30 and 40 shown in FIGS. 7A and 7B along the direction substantially perpendicular to the direction in which the high temperature fluid flows, and the second protrusions 50 are disposed substantially in parallel to the width direction of the core plates 13 and 14. As a result, a more complex flow path is formed in each of the serpentine tubes. The present invention, however, is not limited to the configuration described above, but the second protrusions 50 may be intermittently formed. The shape, the direction, the arrangement, and other parameters of the second protrusions 50 shall be designed as appropriate. For example, the second protrusions 50 may be formed successively or intermittently along the direction perpendicular to the direction in which the protrusions 30 and 40 meander or may be formed successively or intermittently along the direction in which the protrusions 30 and 40 meander.

According to the configuration described above, each of the pairs of core plates 13 and 14 form serpentine tubes that meander not only in the direction in which the core plates 13 and 14 are laminated but also in the width direction of the core plates 13 and 14. The high temperature fluid compartment is formed in each of the serpentine tubes, and the low temperature fluid compartment is formed in the area sandwiched between adjacent serpentine tubes. Since each of the serpentine tubes eliminates the need for fins but forms a complex flow path, the heat transfer area of the core plates 13 and 14 increases. Further, since the length from the inlet to the outlet of each of the fluid compartments (path length) increases, the heat exchange efficiency is improved by approximately 10 to 20%. The plate laminate type heat exchanger 200 without fins can therefore maintain heat exchange efficiency equivalent to that obtained when fins are provided. Further, fins can be completely omitted in each of the cores 15. Moreover, reducing the number of fins or omitting fins allows the number of part and hence the cost to be reduced.

The plate laminate type heat exchanger 200 is configured in such a way that the high temperature fluid flows through the serpentine tubes from one end to the other end in the longitudinal direction, and hence has a structure similar to that of a tube type heat exchanger. The plate laminate type heat exchanger 200, however, has complex flow paths and structurally differs from a tube type heat exchanger in this regard. That is, in a tube type heat exchanger, each fluid compartment is formed of a linear tube and it is structurally difficult to form a serpentine tube that meanders in the laminate and width directions. In a tube type heat exchanger, it is therefore significantly difficult to form complex flow paths in a tube and in the area sandwiched between tubes. In the plate laminate type heat exchanger 200 of the present invention, however, only laminating the core plates 13 and 14 allows formation of complex flow paths. The heat exchange efficiency between the high temperature fluid and the low temperature fluid can thus be significantly improved in the plate laminate type heat exchanger 200.

Figure 8:
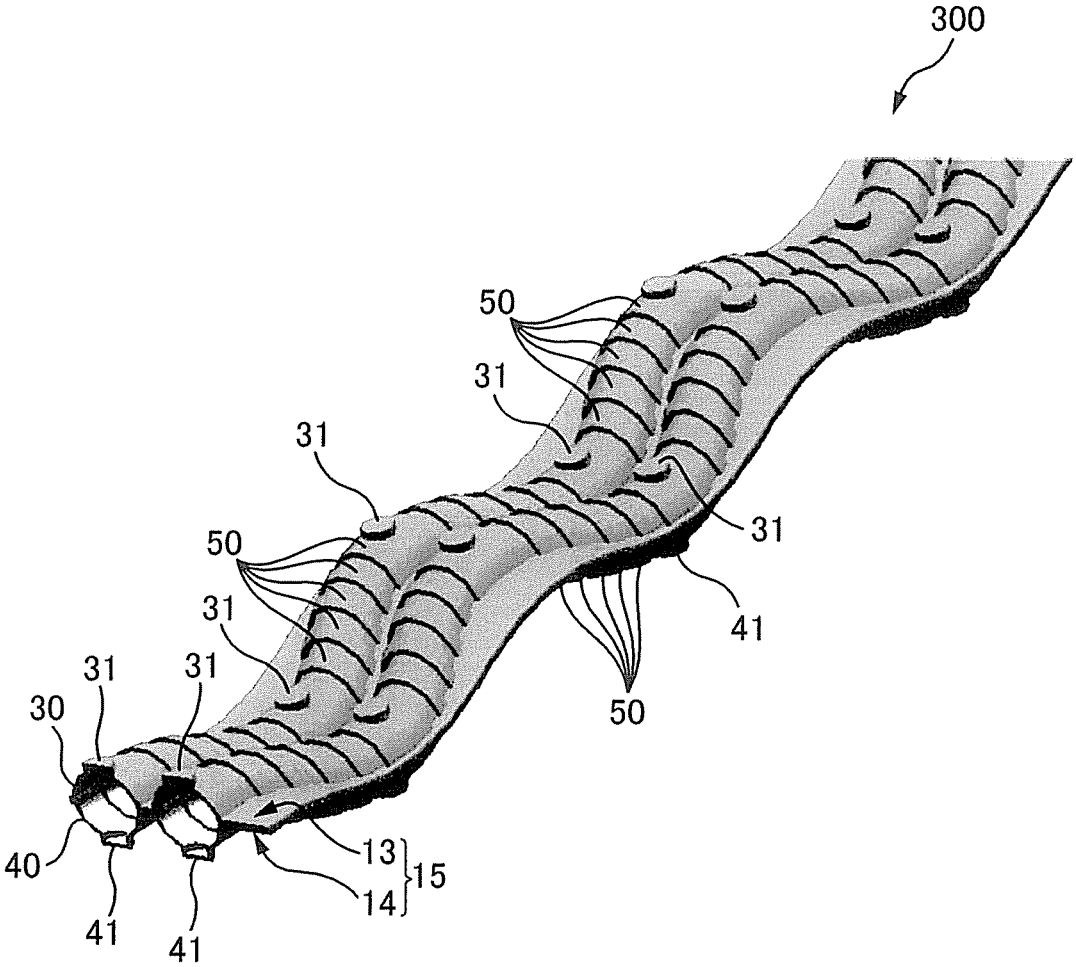
FIG. 8 is a perspective view showing an improved portion of a plate laminate type heat exchanger 300.
Figure 9A:
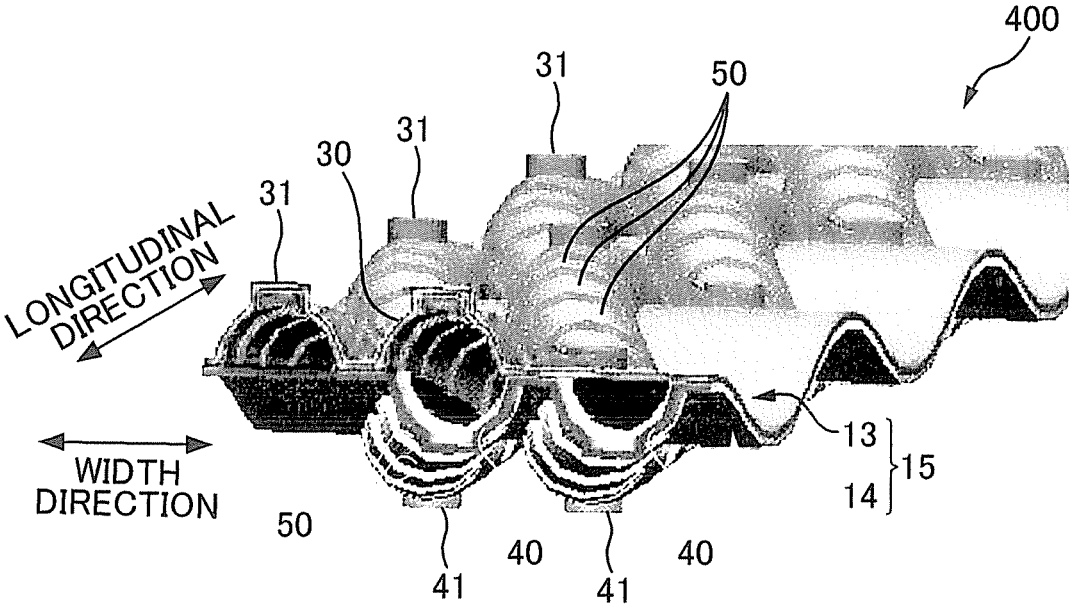
FIG. 9A is an enlarged view showing an improved portion of a plate laminate type heat exchanger 400.
Figure 9B:
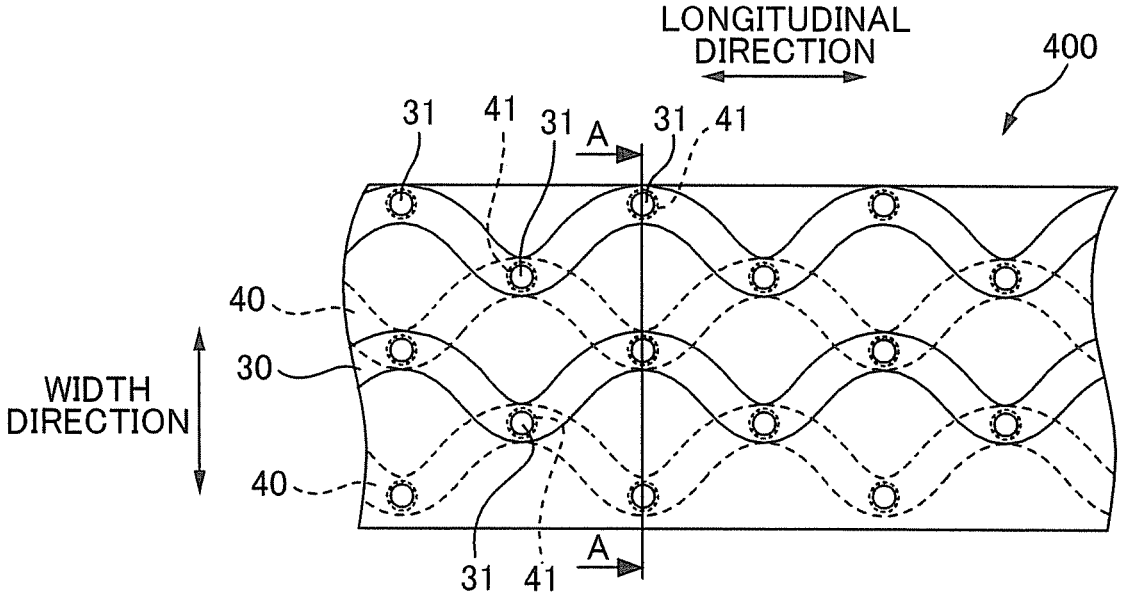
FIG. 9B is a schematic plan view showing the improved portion of the plate laminate type heat exchanger 400.

Other embodiments of the present invention will be described with reference to FIG. 8 and FIGS. 9A, 9B. FIG. 8 is a perspective view showing an improved portion of a plate laminate type heat exchanger 300, and FIGS. 9A and 9B show an improved portion of a plate laminate type heat exchanger 400. In FIG. 8 and FIGS. 9A, 9B, the portions that are the same as or similar to those in FIGS. 6A, 6B and FIGS. 7A, 7B have the same reference characters.

As shown in FIG. 8 and FIGS. 9A, 9B, each of the plate laminate type heat exchangers 300 and 400 has a configuration substantially the same as that of the plate laminate type heat exchanger 200 shown in FIGS. 7A and 7B, but structurally differs from the plate laminate type heat exchanger 200 in that the cross-sectional shape of each of the protrusions 30 and 40 is not substantially rectangular but substantially hemispherical. In the plate laminate type heat exchanger 300 shown in FIG. 8, the protrusions 30 and 40 meander along the longitudinal direction in an in-phase manner, and a pair of protrusions 30 and 40 form a serpentine tube surrounded by the walls of the protrusions 30 and 40, which are in phase. The serpentine tube has a substantially circular cross-sectional shape and forms a complex flow path that eliminates the need for fins. As a result, the heat transfer area of the core plates 13 and 14 increases in the present embodiment as well. Further, since the length from the inlet to the outlet of each of the fluid compartments (path length) increases, the heat exchange efficiency is improved.

On the other hand, in the plate laminate type heat exchanger 400 shown in FIGS. 9A and 9B, the protrusions 30 and 40 are configured to meander along the longitudinal direction of the core plates 13 and 14 in an anti-phase manner (see FIG. 9A). FIG. 9B is a schematic plan view of the plate laminate type heat exchanger 400 shown in FIG. 9A, and the cross-sectional view taken along the line A-A in FIG. 9B substantially corresponds to FIG. 9A. It is noted, however, that FIG. 9B does not show the second protrusions 50 shown in FIG. 9A.

According to the configuration described above, a pair of core plates 13 and 14 form complex flow paths formed by the walls of the protrusions 30 and 40, and the complex flow paths allow the high temperature fluid to be agitated at their intersections. As a result, the heat exchange efficiency between the high temperature fluid and the low temperature fluid is significantly improved. The plate laminate type heat exchangers 300 and 400 can therefore readily maintain heat exchange efficiency equivalent to that obtained when fins are provided. Further, fins can be completely omitted in each of the pairs.

INDUSTRIAL APPLICABILITY

The present invention can provide a plate laminate type heat exchanger having high heat exchange efficiency.

The invention claimed is:

1. A plate laminate type heat exchanger comprising:

front and rear end plates;

a plurality of pairs of flat core plates, defining a longitudinal direction and being laminated between the front and rear end plates; and high temperature fluid compartments through which high temperature fluid flows and low temperature fluid compartments through which low temperature fluid flows defined in the space surrounded by the end plates and the core plates by bonding peripheral flanges of each of the pairs of core plates to each other in a brazing process, each of the fluid compartments communicating with a pair of circulation pipes provided on the front or rear end plate in such a way that the circulation pipes jut therefrom, the plate laminate type heat exchanger wherein each of the core plates has a substantially parallelogram shape when viewed in the laminate direction, a plurality of groove-like protrusions is formed on one side of each of the flat core plates, the protrusions are disposed substantially in parallel to the longitudinal direction of the plate, a substantially circular-shaped inlet port for high temperature fluid and a substantially triangular-shaped outlet port for low temperature fluid are provided in each of the core plates on one end side in the longitudinal direction thereof, and a substantially circular-shaped outlet port for high temperature fluid and a substantially triangular-shaped inlet port for low temperature fluid are provided in each of the core plates on the other end side in the longitudinal direction thereof, the pair of the inlet port for high temperature fluid and the outlet port for high temperature fluid are disposed at each of a pair of corners whose diagonal angles are larger than those of the other pair of corners on the core plate, whereas the pair of the inlet port for low temperature fluid and the outlet port for low temperature fluid are disposed at each of the other pair of corners on the core plate, the substantially triangular-shaped inlet and outlet ports for low temperature fluid having an angle being substantially congruent with the diagonal angles of the other pair of corners, both ends of each of the protrusions converge into the inlet port for high temperature fluid and the outlet port for high temperature fluid, respectively, each of the pairs of core plates is assembled in such a way that the side of one of the two core plates that is opposite the one side faces the side of the other one of the two core plates that is opposite the one side and the protrusions formed on the respective core plates are paired but oriented in opposite directions, and the pair of core plates form a plurality of tubes surrounded by the walls of the protrusions formed on the respective core plates, the protrusions connecting the inlet port for high temperature fluid to the outlet port for high temperature fluid with substantially arcuate shapes, and one end of each of the protrusions forming the tubes is in contact with an edge of the inlet port for high temperature fluid from which the high temperature fluid flows out, the other end of each protrusion is in contact with an edge of the outlet port for high temperature which the high temperature fluid flows in, in such a way that a tube having a shorter end-to-end length has a smaller cross-sectional area in the width direction of the core plates, and the tubes form the corresponding high temperature fluid compartments, a flow path is formed on one end side in the longitudinal direction at which the inlet port for high temperature fluid is provided, such that low temperature fluid flows around an outside of the inlet port of high temperature fluid, and a flow path is formed on the other end side in the longitudinal direction at which the outlet port for high temperature fluid is provided, such that low temperature fluid flows around an outside of the outlet port of high temperature fluid.

2. The plate laminate type heat exchanger according to claim 1, wherein second protrusions are formed on the walls that form the protrusions along the direction substantially perpendicular to the direction in which the high temperature fluid flows.

3. A plate laminate type heat exchanger comprising:

front and rear end plates;

a plurality of pairs of flat core plates, defining a longitudinal direction and being laminated between the front and rear end plates; and high temperature fluid compartments through which high temperature fluid flows and low temperature fluid compartments through which low temperature fluid flows defined in the space surrounded by the end plates and the core plates by bonding peripheral flanges of each of the pairs of core plates to each other in a brazing process, each of the fluid compartments communicating with a pair of circulation pipes provided on the front or rear end plate in such a way that the circulation pipes jut therefrom, the plate laminate type heat exchanger wherein each of the core plates has a substantially parallelogram shape when viewed in the laminate direction, a plurality of groove-like protrusions is formed on one side of each of the flat core plates, the protrusions are disposed substantially in parallel to longitudinal direction of the plate, each of the plates is curved in such a way that ridges and valleys are formed in the direction in which the plates are laminated and the ridges and valleys are repeated along the longitudinal direction of the plates, a substantially circular-shaped inlet port for high temperature fluid and a substantially triangular-shaped outlet port for low temperature fluid are provided in each of the core plates on one end side in the longitudinal direction thereof, and a substantially circular-shaped outlet port for high temperature fluid and a substantially triangular-shaped inlet port for low temperature fluid are provided in each of the core plates on the other end side in the longitudinal direction thereof, the pair of the inlet port for high temperature fluid and the outlet port for high temperature fluid are disposed at each of a pair of corners whose diagonal angles are larger than those of the other pair of corners on the core plate, whereas the pair of the inlet port for low temperature fluid and the outlet port for low temperature fluid are disposed at each of the other pair of corners on the core plate, the substantially triangular-shaped inlet and outlet ports for low temperature fluid having an angle being substantially congruent with the diagonal angles of the other pair of corners, both ends of each of the protrusions converge into the inlet port for high temperature fluid and the outlet port for high temperature fluid, respectively, and each of the pairs of core plates is assembled in such a way that the side of one of the two core plates that is opposite the one side faces the side of the other one of the two core plates that is opposite the one side and the protrusions formed on the respective core plates are paired but oriented in opposite directions, and the pair of core plates form a plurality of tubes surrounded by the walls of the protrusions formed on the respective core plates, the protrusions connecting the inlet port for high temperature fluid to the outlet port for high temperature fluid with substantially arcuate shapes, and one end of each of the protrusions forming the tubes is in contact with an edge of the inlet port for high temperature fluid from which the high temperature fluid flows out, the other end of each protrusion is in contact with an edge of the outlet port for high temperature which the high temperature fluid flows in, in such a way that a tube having a shorter end-to-end length has a smaller cross-sectional area in the width direction of the core plates, and the tubes form the corresponding high temperature fluid compartments, a flow path is formed on one end side in the longitudinal direction at which the inlet port for high temperature fluid is provided, such that low temperature fluid flows around an outside of the inlet port of high temperature fluid, and a flow path is formed on the other end side in the longitudinal direction at which the outlet port for high temperature fluid is provided, such that low temperature fluid flows around an outside of the outlet port of high temperature fluid.

4. The plate laminate type heat exchanger according to claim 3, wherein each of the protrusions also has ridges and valleys formed in the width direction of the core plates perpendicular to the longitudinal direction of the core plates, and the ridges and valleys are repeated along the longitudinal direction of the core plates.

5. The plate laminate type heat exchanger according to claim 4, wherein the protrusions formed on each of the pairs of core plates are the same in terms of the period and the amplitude of the waves formed of the ridges and valleys formed in the width direction of the core plates.

6. The plate laminate type heat exchanger according to claim 5, wherein the protrusions meander in an in-phase manner along the longitudinal direction of the core plates.

7. The plate laminate type heat exchanger according to claim 6, wherein each of the pairs of core plates form a plurality of serpentine tubes surrounded by the walls of the protrusions, and the serpentine tubes form the corresponding high temperature fluid compartments.

8. The plate laminate type heat exchanger according to claim 7, wherein second protrusions are formed on the walls that form the protrusions along the direction substantially perpendicular to the direction in which the high temperature fluid flows.

9. The plate laminate type heat exchanger according to claim 6, wherein second protrusions are formed on the walls that form the protrusions along the direction substantially perpendicular to the direction in which the high temperature fluid flows.

10. The plate laminate type heat exchanger according to claim 5, wherein the protrusions meander in an anti-phase manner along the longitudinal direction of the core plates.

11. The plate laminate type heat exchanger according to claim 10, wherein second protrusions are formed on the walls that form the protrusions along the direction substantially perpendicular to the direction in which the high temperature fluid flows.

12. The plate laminate type heat exchanger according to claim 5, wherein second protrusions are formed on the walls that form the protrusions along the direction substantially perpendicular to the direction in which the high temperature fluid flows.

13. The plate laminate type heat exchanger according to claim 4, wherein second protrusions are formed on the walls that form the protrusions along the direction substantially perpendicular to the direction in which the high temperature fluid flows.

14. The plate laminate type heat exchanger according to claim 3, wherein second protrusions are formed on the walls that form the protrusions along the direction substantially perpendicular to the direction in which the high temperature fluid flows.

* * * * *